US006633262B1

(12) United States Patent
Shoji et al.

(10) Patent No.: US 6,633,262 B1
(45) Date of Patent: Oct. 14, 2003

(54) PORTABLE WIRELESS TERMINAL

(75) Inventors: Hideaki Shoji, Hyogo (JP); Yasuhito Imanishi, Hyogo (JP); Toru Fukasawa, Hyogo (JP); Hiroyuki Ohmine, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/030,116

(22) PCT Filed: Jun. 1, 2000

(86) PCT No.: PCT/JP00/03527

§ 371 (c)(1),
(2), (4) Date: Jan. 23, 2002

(87) PCT Pub. No.: WO01/93367

PCT Pub. Date: Dec. 6, 2001

(51) Int. Cl.[7] ..... H01Q 1/24
(52) U.S. Cl. ..... 343/702; 343/841
(58) Field of Search ..... 343/702, 829, 343/841, 846; 455/89, 90; H01Q 1/24, 1/36

(56) References Cited

U.S. PATENT DOCUMENTS 5,335,366 A * 8/1994 Daniels ..... 455/89
5,874,920 A * 2/1999 Araki et al. ..... 343/702
5,986,608 A * 11/1999 Korisch et al. ..... 343/702
6,285,327 B1 * 9/2001 See ..... 343/702
6,295,462 B1 * 9/2001 Kudoh ..... 455/562

FOREIGN PATENT DOCUMENTS

| | | |
|---|---|---|
| JP | 6-152221 | 5/1994 |
| JP | 6-291711 | 10/1994 |
| JP | 7-038316 | 2/1995 |
| JP | 7-273688 | 10/1995 |
| JP | 7-283631 | 10/1995 |
| JP | 08-222927 | 8/1996 |
| JP | 9-018215 | 1/1997 |
| JP | 11-088209 | 3/1999 |

* cited by examiner

*Primary Examiner*—Tho Phan
(74) *Attorney, Agent, or Firm*—Oblon, Spivak, McClelland, Maier & Neustadt, P.C.

(57) ABSTRACT

A portable telephone includes a metal substrate, a shield box, a monopole antenna and a feed unit. The surface of the metal substrate includes a conductive metal layer. The shield box covers a radio transmitter-receiver unit provided on the metal substrate to electromagnetically shield the radio transmitter-receiver unit, and has conductivity. The monopole antenna extends in a predetermined direction, and has an electrical length of $(\lambda/2)\times N$ (N is an integer). The feed unit is provided at the metal substrate so as to be apart from the shield box in the extending direction of the monopole antenna. The feed unit includes a matching circuit.

5 Claims, 14 Drawing Sheets

PORTABLE WIRELESS TERMINAL

TECHNICAL FIELD

The present invention relates to portable radio terminals, particularly to a portable telephone as the portable radio terminal.

BACKGROUND ART

A portable telephone generally includes an antenna element to transmit and receive electromagnetic waves, and a radio transmitter-receiver provided in the portable telephone to apply energy to the antenna element. Since the impedance of the antenna element differs from the impedance of the radio transmitter-receiver, the impedance must be matched. Therefore, a matching circuit is provided between the radio transmitter-receiver and the antenna element in a conventional portable telephone for impedance matching.

FIG. 15 shows a structure of a conventional portable telephone. Referring to FIG. 15, a conventional portable telephone 401 includes a main unit case 410, a metal substrate 411, a feed unit 412, a matching circuit 413, a shield box 414, and a monopole antenna 421.

Metal substrate 411 is housed in main unit case 410. Shield box 414 is disposed at the surface of metal substrate 411, and matching circuit 413 constituting feed unit 412 is provided in the proximity of shield box 414. Monopole antenna 421 is connected to matching circuit 413.

Main unit case 410 is of a hollow configuration with metal substrate 411 located therein. Metal substrate 411 includes an epoxy glass material and a conductor layer 441*a* formed of copper at the surface thereof. Metal substrate 411 is of a rectangular configuration and has long sides and short sides.

Shield box 414 is provided at the upper portion of metal substrate 411. A radio transmitter-receiver is provided in shield box 414 to extract the information included in the wave received by monopole antenna 421 and to apply a predetermined energy to monopole antenna 421 to radiate waves. The radio transmitter-receiver is covered with shield box 414 to be shielded electromagnetically. Shield box 414 is configured, for example, by a layered body of copper and nickel with a nickel layer formed at the surface of copper.

Matching circuit 413 configuring feed unit 412 is provided so as to face a portion of shield box 414. Matching circuit 413 is formed of a lumped constant element such as coils and capacitors. Matching circuit 413 has a portion connected to the radio transmitter-receiver in shield box 414. The remaining portion of matching circuit 413 is connected to monopole antenna 421.

Monopole antenna 421 is attached to matching circuit 413 so as to extend in a predetermined direction. Monopole antenna 421 extends along the longitudinal direction of metal substrate 411 and main unit case 410. The electrical length of monopole antenna 421 is mainly set to $\lambda/4$ or $\lambda/2$.

The problem induced by such a conventional portable telephone 401 will be described hereinafter.

In general, when monopole antenna 421 receives a wave, a current flow is conducted from feed unit 412 to the radio transmitter-receiver in shield box 414. However, a current that flows at the surface of shield box 414 as shown by arrow 430 is also present. There is also a current that bypasses the surface of metal substrate 411 to flow to the radio transmitter-receiver. Since the conductivity of metal substrate 411 and shield box 414 is poor with respect to the antenna conductor, heat is generated at this area to result in signal loss.

The present invention is directed to solve such a problem. An object of the present invention is to provide a portable radio terminal that has a high antenna efficiency and improved in gain.

DISCLOSURE OF THE INVENTION

A portable radio terminal according to an aspect of the present invention includes a substrate, a shield member, an antenna element, and a feed unit. The substrate includes a portion having a conductive surface. The shield member covers a radio transmitter-receiver provided on the substrate to shield the radio transmitter-receiver electromagnetically, and has conductivity. The antenna element has an electrical length of $(\lambda/2)\times N$ (N is an integer), and extends in a predetermined direction. The feed unit is provided at the substrate so as to be apart from the shield member in an extending direction of the antenna element, and includes a matching circuit connected to the antenna element.

In the portable radio terminal of the above structure, the feed unit is provided at the substrate so as to be apart from the shield member in the extending direction of the antenna element. Since the feed unit is apart from the shield member in the extending direction of the antenna element, the current flowing to the shield member can be reduced to prevent occurrence of a loss in electric signals. Thus, a portable radio terminal of high antenna efficiency and improved in gain can be provided.

Preferably, the end portion of the substrate is dielectric at the surface. The feed unit is provided at the portion of the substrate that is dielectric. Since there is no conductive portion where the feed unit is located, the current flowing to the conductive portion can be reduced. As a result, a loss in the electric signal can be prevented. Thus, a portable radio terminal of high antenna efficiency and improved in gain can be provided.

Also preferably, the end portion of the substrate has a protruding portion where the feed unit is provided. Since the feed unit provided at the protruding portion is immune to the effect of the shield member, a loss in electrical signals can further be prevented effectively.

Preferably, the shield member, feed unit and antenna element are provided sequentially so as to be distant from the substrate along the extending direction of the antenna element. Since the feed unit is provided apart from the substrate, the current flowing to the conductive portion can be reduced. As a result, a loss in the electric signal can be prevented. Thus, a portable radio terminal of high antenna efficiency and improved in gain can be provided.

A portable radio terminal according to another aspect of the present invention includes a substrate, a shield member, a dielectric, a feed unit, and an antenna element. The surface of the substrate is conductive. The shield member covers a radio transmitter-receiver provided on the substrate to shield the radio transmitter-receiver electromagnetically, and has conductivity. The dielectric is provided on the substrate. The feed unit is provided on the dielectric so as to be apart from the surface of the substrate in the thickness direction of the substrate, and includes a matching circuit. The antenna element has an electrical length of $(\lambda/2)\times N$ (N is an integer), and is connected to the feed unit.

In the portable radio terminal of the above structure, the feed unit is provided on the dielectric so as to be apart in the thickness direction of the substrate's surface. Since the feed unit is provided apart in the direction perpendicular to the surface of the substrate, the current flowing from the feed unit to the shield member or to the surface of the substrate can be reduced. As a result, a loss in electric signals can be prevented. Thus, a portable radio terminal of high antenna efficiency and improved in gain can be provided.

BEST MODES FOR CARRYING OUT THE INVENTION

Embodiments of the present invention will be described hereinafter with reference to the drawings.

First Embodiment

Figure 1:
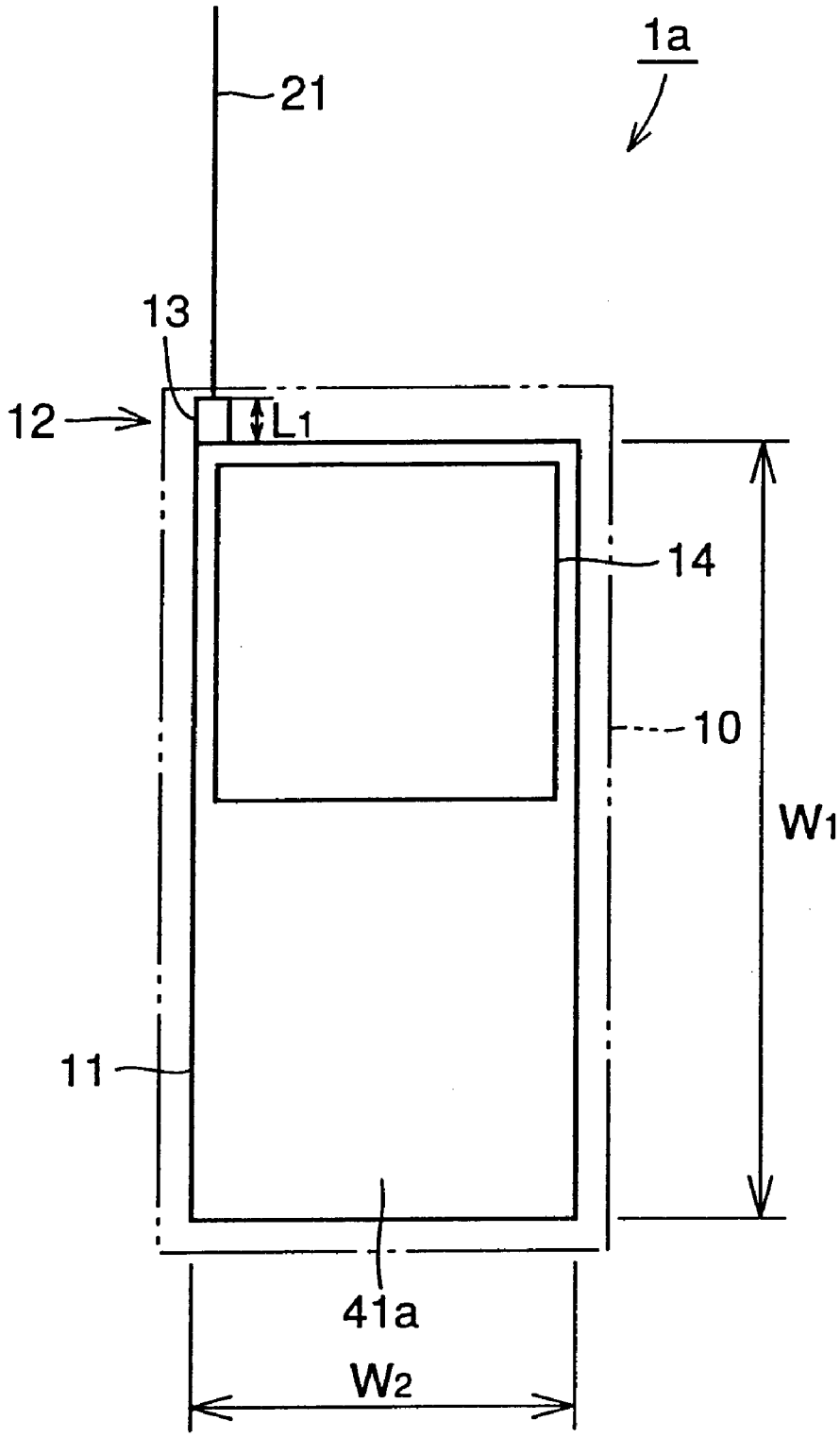
FIG. 1 is a plan view of a portable telephone according to a first embodiment of the present invention.

FIG. 1 is a plan view of a portable telephone according to a first embodiment of the present invention. Referring to FIG. 1, a portable telephone 1*a* as the portable radio terminal of the first embodiment of the present invention includes a metal substrate 11 as the substrate, a shield box 14 as the shield member, a monopole antenna 21 as the antenna element, and a feed unit 12.

A metal layer 41*a* having conductivity is formed at the surface of metal substrate 11. Shield box 14 covers the radio transmitter-receiver provided on metal substrate 11 to shield the radio transmitter-receiver electromagnetically, and has conductivity. The electrical length of monopole antenna 21 is $(\lambda/2)\times N$ (N is an integer). Monopole antenna 21 is formed to extend in a predetermined direction. Feed unit 12 has a matching circuit 13 connected to monopole antenna 21. Feed unit 12 is provided on metal substrate 11 apart from shield box 14 in the extending direction of monopole antenna 21.

Metal substrate 11, feed unit 12, matching circuit 13 and shield box 14 are accommodated in main unit case 10. Metal substrate 11 includes an insulator formed of an epoxy glass material, and a metal layer 41*a* formed of copper on the insulator.

At the surface of metal layer 41*a* is provided a metal shield box 14 of substantially a cuboid configuration. Shield box 14 is constituted by, for example, a layered body having a nickel layer formed at the surface of copper. A radio transmitter-receiver is provided in the space enclosed by shield box 14. This radio transmitter-receiver is connected to matching circuit 13 through a microstrip line or coaxial cable.

Monopole antenna 21 can be replaced with another antenna element such as a helical element. Also, a monopole antenna and a helical antenna can be coupled through ABS (alkyl benzene sulfonic acid) resin or the like to be attached to matching circuit 13.

Figure 2:
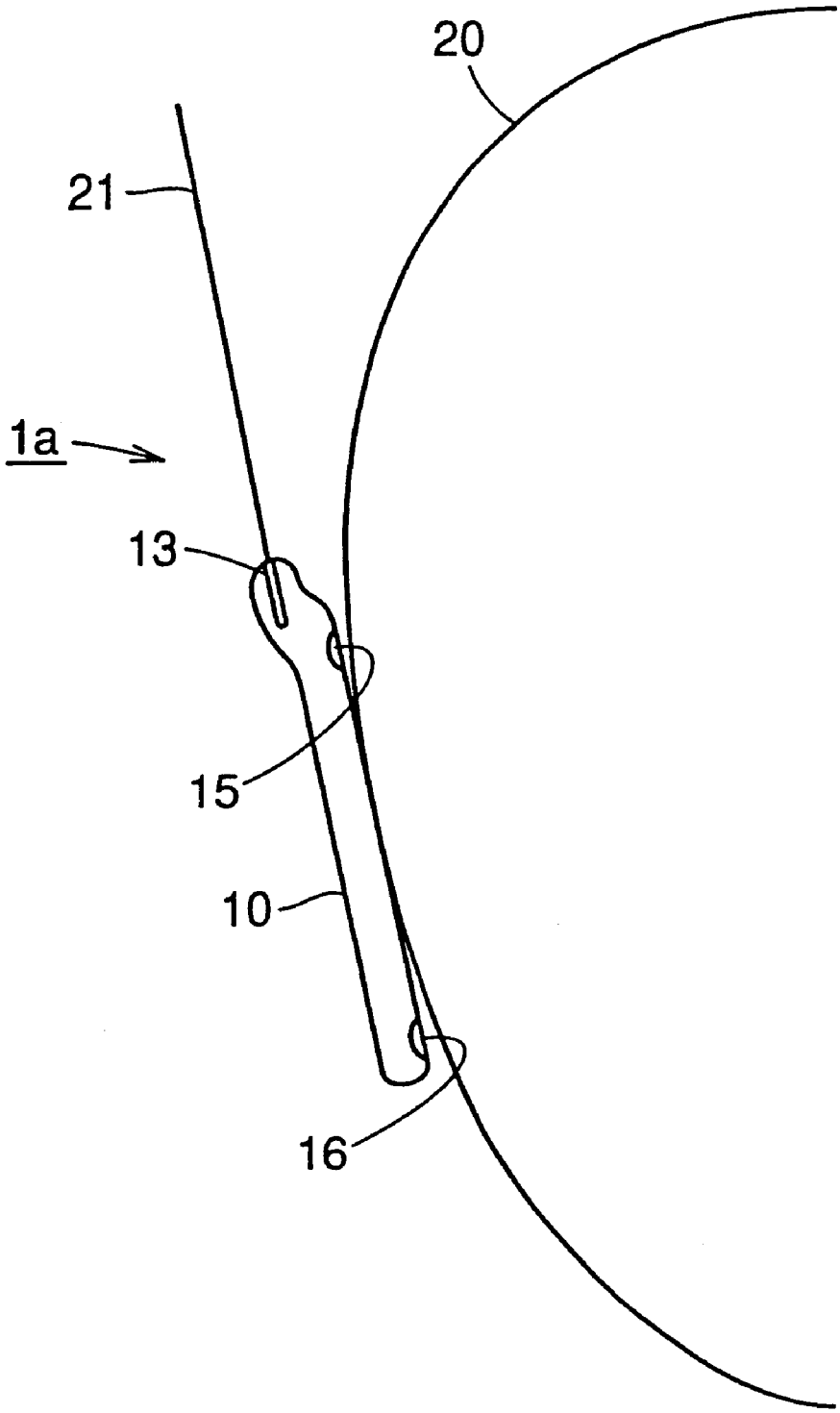
FIG. 2 is a side view of a portable telephone of the first embodiment shown in FIG. 1 in a used state.

FIG. 2 is a side view of the portable telephone according to the first embodiment of the present invention shown in FIG. 1 in a used state. Referring to FIG. 2, portable telephone 1*a* includes main unit 10, matching circuit 13 and monopole antenna 21. Main unit case 10 is formed to extend in one direction, and has a speaker 15 that is to be located close to one's ear and a microphone 16 that is to be located close to one's mouth, provided at the surface. The surface where speaker 15 and microphone 16 are provided is formed so as to fit along one's head 20. Matching circuit 13 is disposed in main unit case 10. Main unit case 10 extends so as to be distant from one's head 20 as a function of approach to monopole antenna 21. Matching circuit 13 is provided at the end portion of main unit case 10. In main unit 10, the face side where microphone 16 and speaker 15 are provided is the front surface and the opposite side thereof is the back surface. Matching circuit 13 is provided in the proximity of the back surface, apart from one's head 20.

Figure 3:
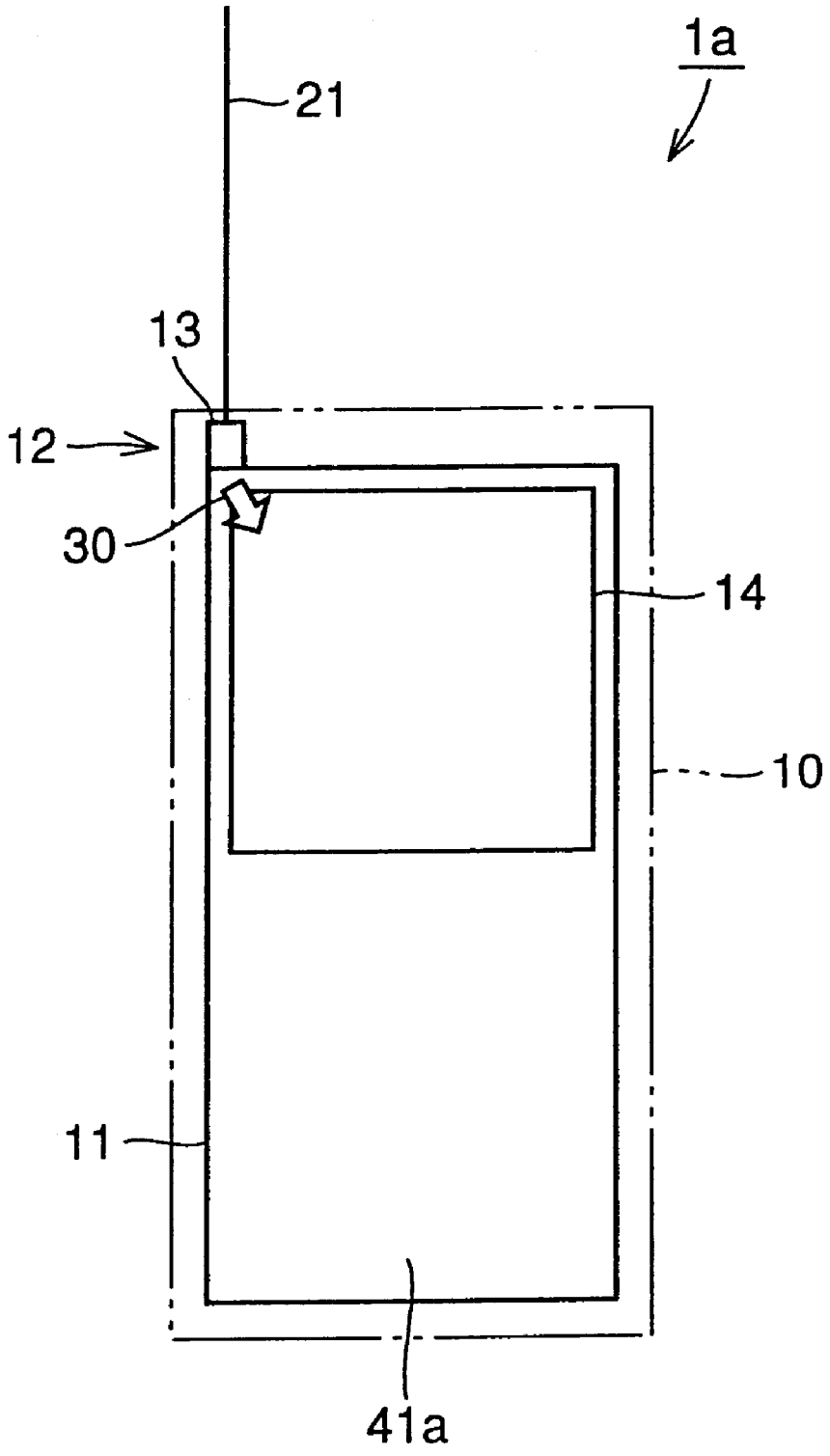
FIG. 3 is a plan view of the portable telephone according to the first embodiment of the present invention to describe the operation of the portable telephone of the first embodiment of the present invention.

FIG. 3 is a plan view of the portable telephone according to the first embodiment of the present invention to describe the operation thereof. Referring to FIG. 3, portable telephone 1*a* of the present invention has feed unit 12 with matching circuit 13 provided apart from the shield box and metal substrate 11 in the extending direction of monopole antenna 21. Therefore, the current is conducted to the radio transmitter-receiver in shield box 14 from feed unit 12 as indicated by arrow 30. Accordingly, the current flowing to the surface of shield box 14 can be reduced. Also, the current flowing to the surface of metal substrate 11 can be reduced. As a result, the loss can be prevented. A portable telephone improved in antenna efficiency and of high gain can be provided.

Second Embodiment

Figure 4:
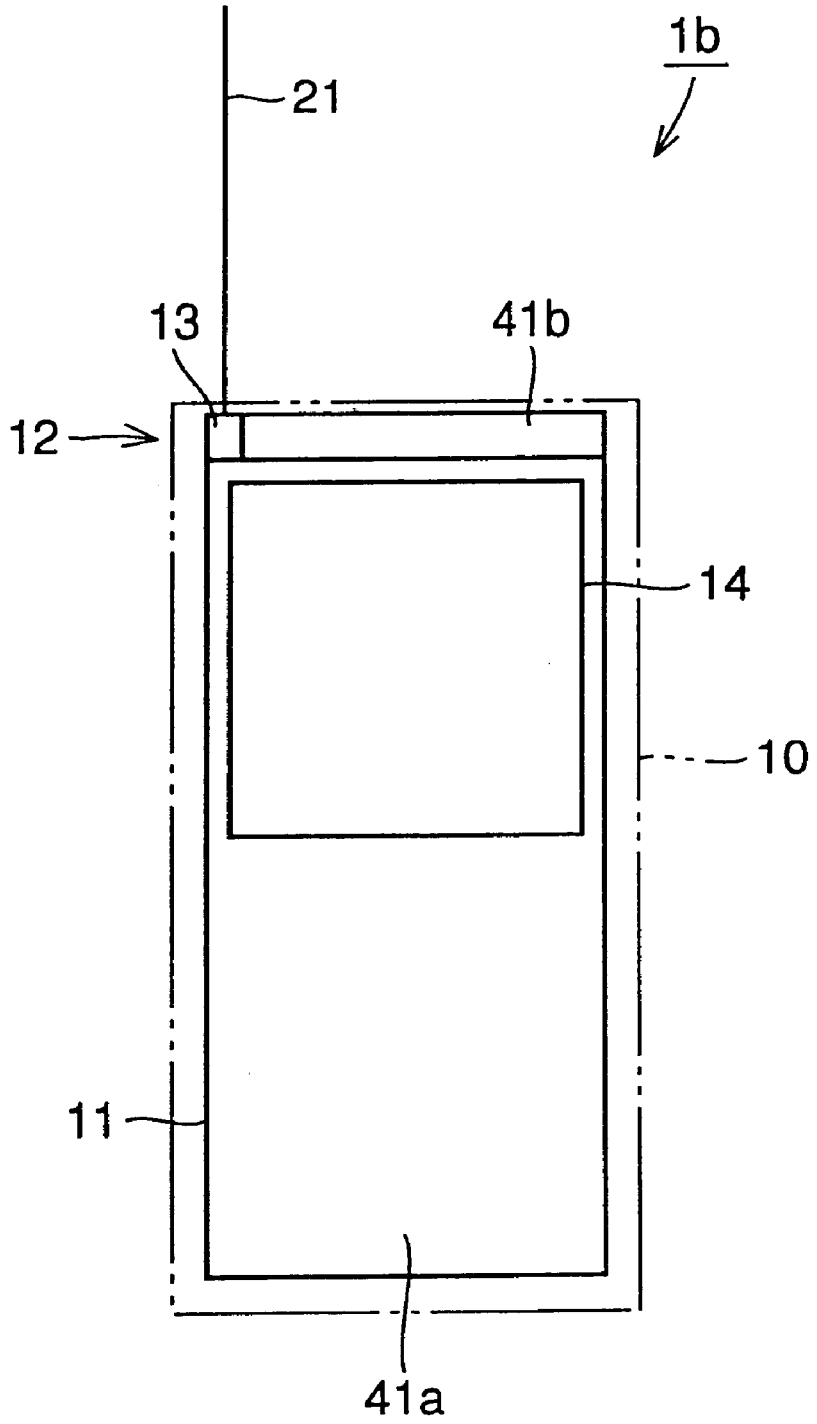
FIG. 4 is a plan view of the portable telephone according to a second embodiment of the present invention.

FIG. 4 is a plan view of a portable telephone according to a second embodiment of the present invention. Referring to FIG. 4, a portable telephone 1*b* of the second embodiment differs from portable telephone 1*a* of FIG. 1 in that metal layer 41*a* at the end of metal substrate 11 is absent and that a dielectric layer 41*b* with the epoxy glass material exposed is provided. Feed unit 12 with matching circuit 13 is provided on a dielectric layer 41*b*. Monopole antenna 21 is connected to matching circuit 13.

Portable telephone 1*b* of the above structure provides advantageous effects similar to those of portable telephone 1*a* of the first embodiment. Furthermore, feed unit 12 is formed on dielectric layer 41*b* that is not conductive. Therefore, the current flowing to the surface of metal layer 41*a* at the surface of metal substrate 11 can be reduced. As a result, a portable telephone that has reduction in the antenna efficiency prevented and of high gain can be provided.

Portable telephone 1*b* of the second embodiment is advantageous in that dielectric layer 41*b* can be fabricated by a simple process since dielectric layer 41*b* can be exposed by just removing metal layer 41*a* at the leading end of metal substrate 11.

Third Embodiment

Figure 5:
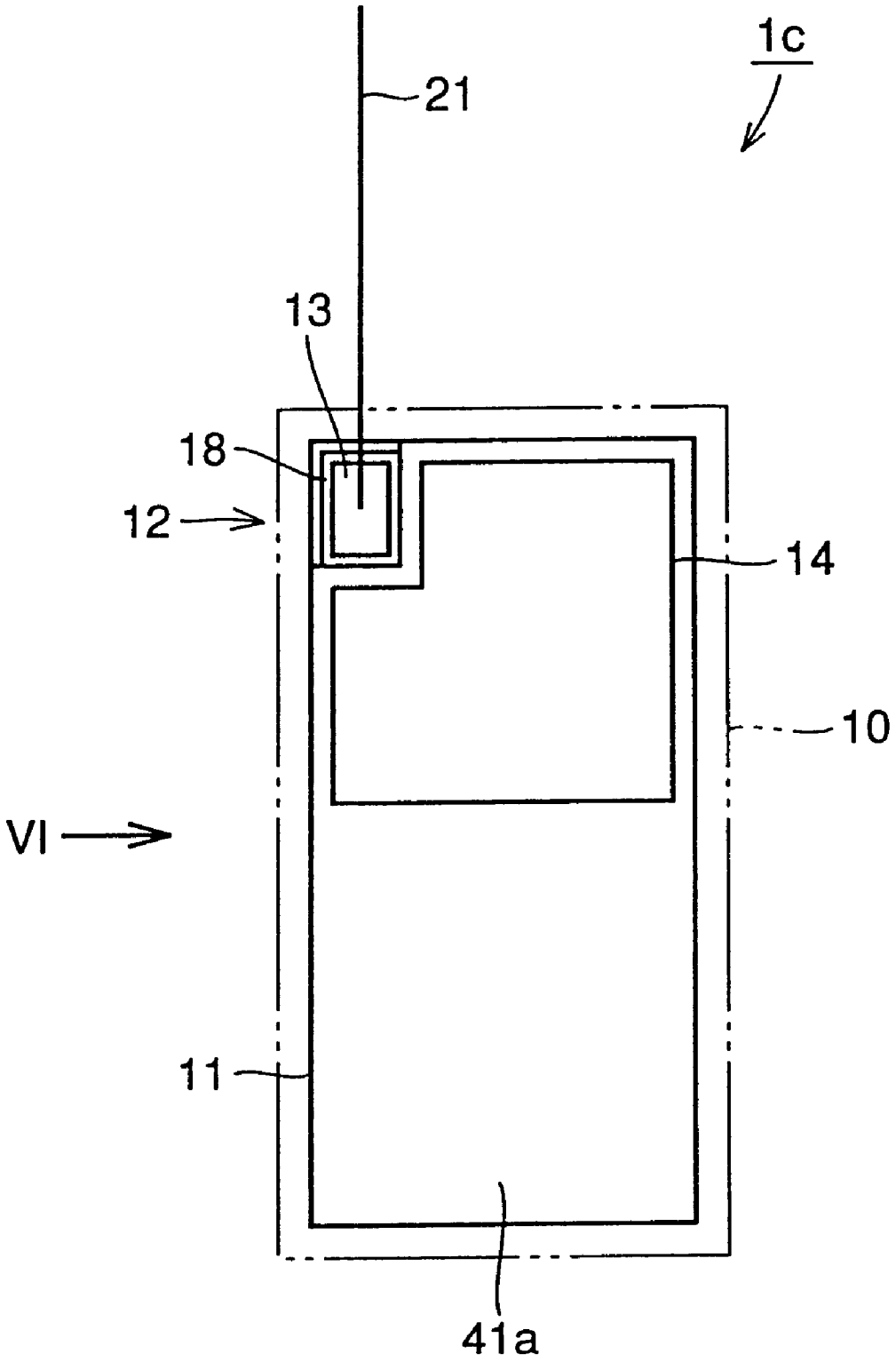
FIG. 5 is a plan view of a portable telephone according to a third embodiment of the present invention.
Figure 6:
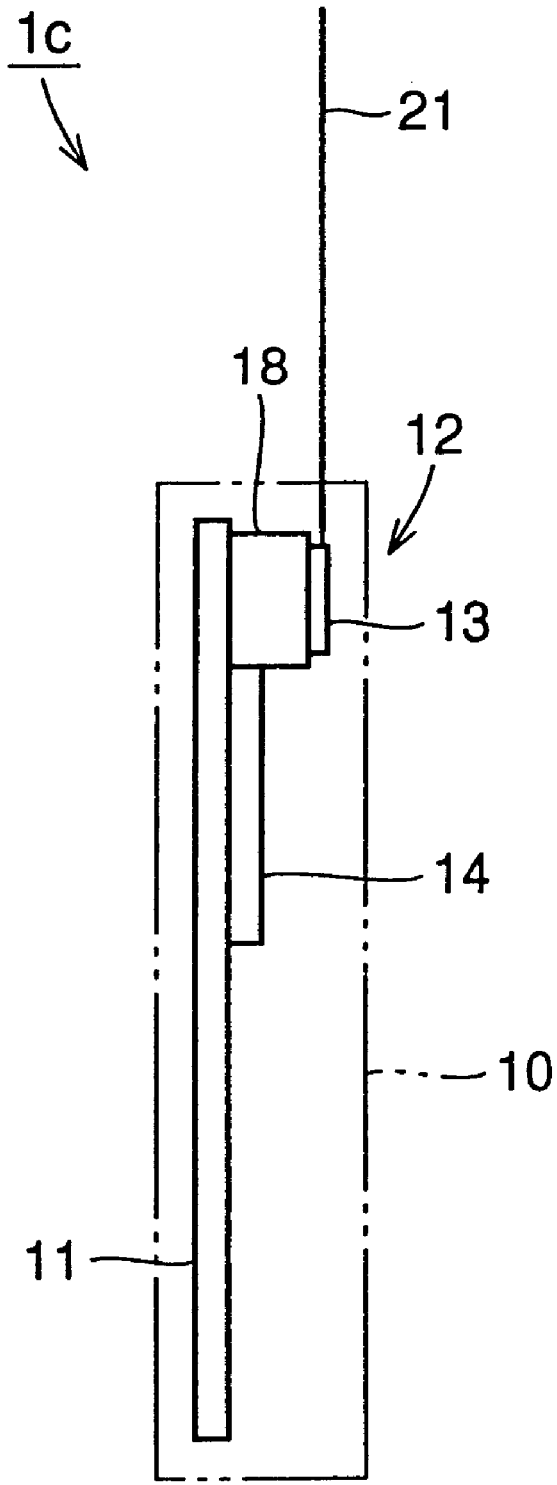
FIG. 6 is a side view of a portable telephone viewed from the direction indicated by arrow VI of FIG. 5.

FIG. 5 is a plan view of a portable telephone according to a third embodiment of the present invention. FIG. 6 is a side view of the portable telephone of the third embodiment viewed from the direction indicated by arrow VI in FIG. 5. Referring to FIGS. 5 and 6, a portable telephone 1*c* of the third embodiment differs from portable telephone 1*a* of FIG. 1 in that matching circuit 13 is provided at the surface of metal substrate 11 with a dielectric block 18 therebetween. Dielectric block 18 is of a cuboid configuration, and has one face in contact with the surface of metal substrate 11 and the other face in contact with matching circuit 13. Dielectric block 18 is formed of a material having a small dielectric dissipation factor (tan δ) and a high relative dielectric constant, for example, a ceramics type material (relative dielectric constant≈7–100), Teflon (relative dielectric constant≈2.1) and resin based material such as Vectra (relative dielectric constant≈3.3). The presence of dielectric block 18 allows feed unit 12 with matching circuit 13 to be provided on dielectric block 18 so as to be apart in the thickness direction of metal substrate 11. In other words, matching circuit 13 is provided apart from the surface of metal substrate 11 in the perpendicular direction.

Dielectric block 18 is enclosed by shield box 14. The height of the top face of shield box 14 from the surface of metal substrate 11 is lower than the height of the top face of matching circuit 13 from the surface of metal substrate 11. Therefore, shield box 14 is located at a relatively low position whereas matching circuit 13 is located at a relatively high position. Monopole antenna 21 may be replaced with a line antenna such as a helical antenna.

Portable telephone 1*c* of the third embodiment configured as described above is characterized in that feed unit 12 with matching circuit 13 is provided on dielectric block 18 so as to be apart in the thickness direction of metal substrate 11. Therefore, the current flowing from matching circuit 13 to the surface of shield box 14 directly or to the surface of metal substrate 11 can be reduced. Since there is no occurrence of a loss in current, a portable telephone improved in antenna efficiency and of high gain can be provided. Furthermore, since matching circuit 13 is formed on dielectric block 18, the wavelength of the wave flowing through matching circuit 13 is reduced. As a result, there is an advantageous effect that matching circuit 13 can be reduced in size.

Fourth Embodiment

Figure 7:
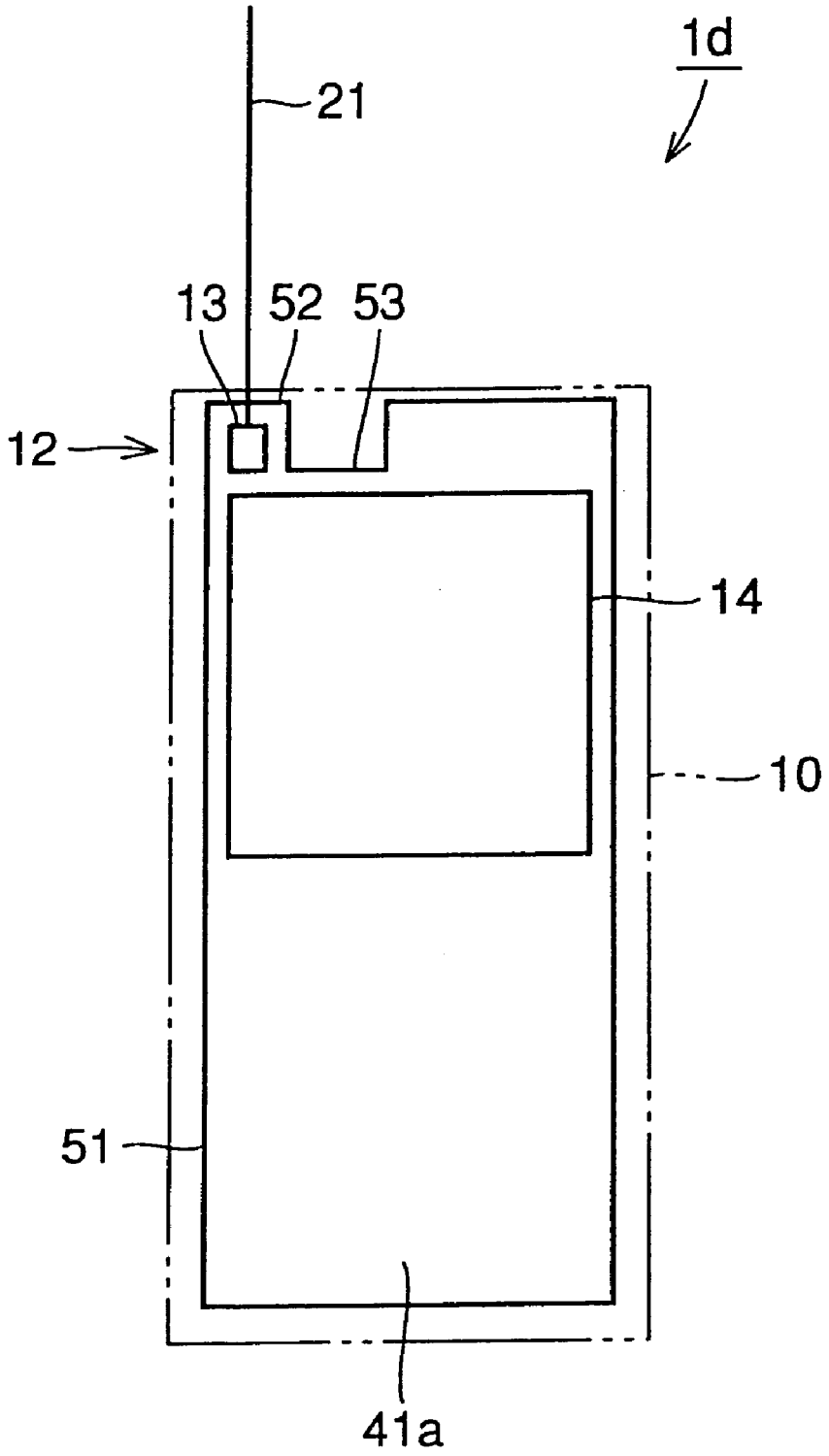
FIG. 7 is a plan view of a portable telephone according to a fourth embodiment of the present invention.

FIG. 7 is a plan view of a portable telephone according to a fourth embodiment of the present invention. Referring to FIG. 7, a portable telephone 1*d* according to the fourth embodiment of the present invention differs from portable telephone 1*a* of FIG. 1 in that a protruding portion 52 is formed at the leading end of metal substrate 11, and feed unit 12 with matching circuit 13 is formed at this protruding portion 52.

A concave 15 is provided adjacent to protruding portion 52. The sizes of concave 53 and protruding portion 52 can be altered appropriately depending upon the size of portable telephone 1*d* and the size of matching circuit 13.

Portable telephone 1*d* of the above configuration provides advantageous effects similar to those of portable telephone 1*a* of the first embodiment.

Specific examples of the present invention will be described hereinafter.

Figure 8:
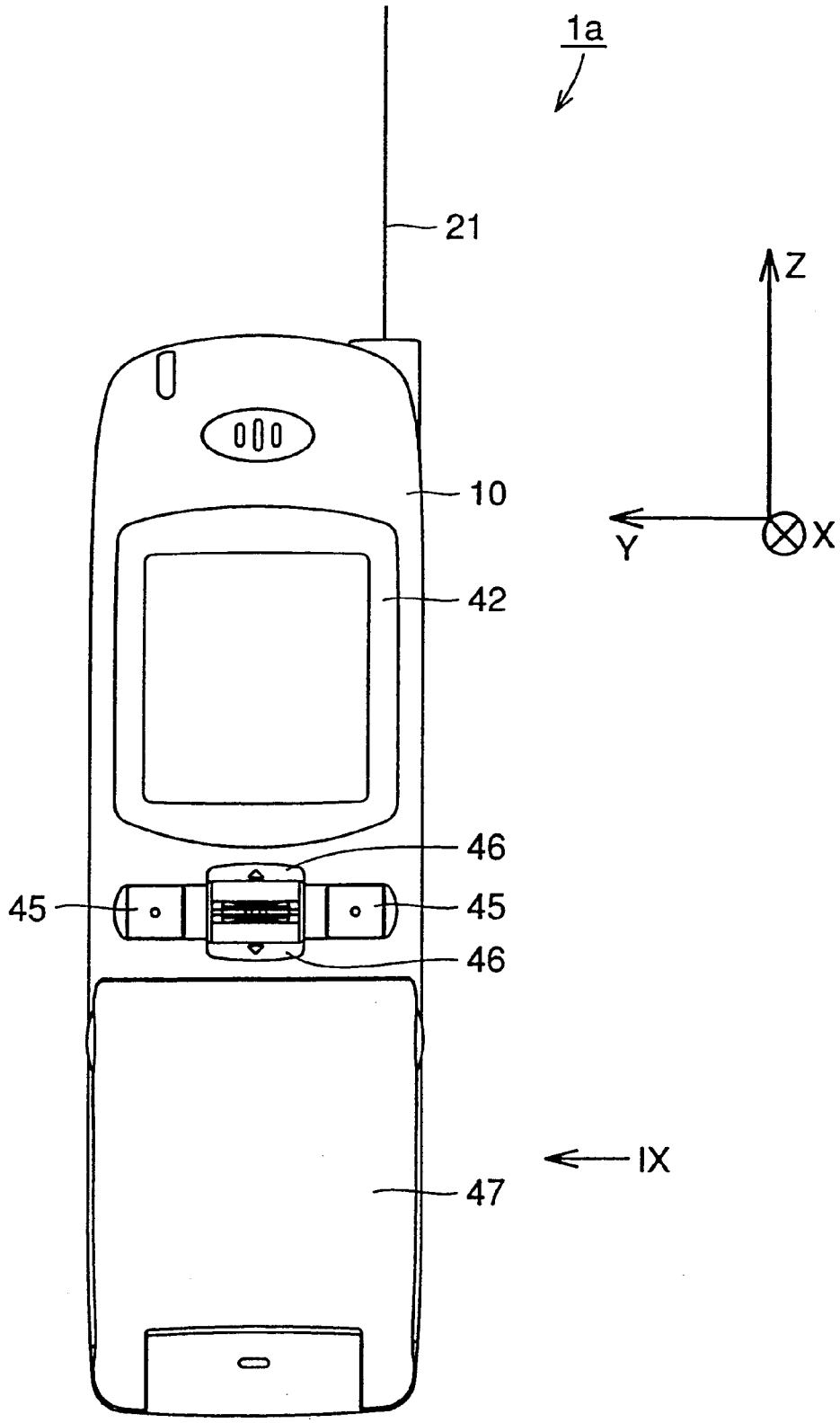
FIG. 8 is a plan view of a portable telephone to describe the relationship between the portable telephone of the present invention and the X, Y and Z axes.

Portable telephone 1*a* of the present invention as shown in FIG. 1 had the length $W_1$ of the longer side and the length $W_2$ of the shorter side of metal substrate 11 set to 0.85 λand 0.2 λ, respectively. The electrical length of monopole antenna 21 was set to λ/2. The distance $L_1$ from metal substrate 11 to the end of monopole antenna 21 was set to 0.05 λ. Such a metal substrate 11 is covered with a main unit case 10 as shown in FIG. 8. A protection window 41 is provided at the surface of main unit case 10. A liquid crystal panel is provided behind protection window 42. A multi-function switch 46 and an operation key 45 are provided at the center area of main unit case 10. A flip 47 is provided at the lower portion of main unit case 10.

Monopole antenna 21 is provided so as to project from main unit case 10. The extending direction of monopole antenna 21 is the +Z direction. The direction from right to left in FIG. 8 is the +Y direction. The direction at right angles to the paper plane of FIG. 8 towards the rear is the +X direction.

Figure 9:
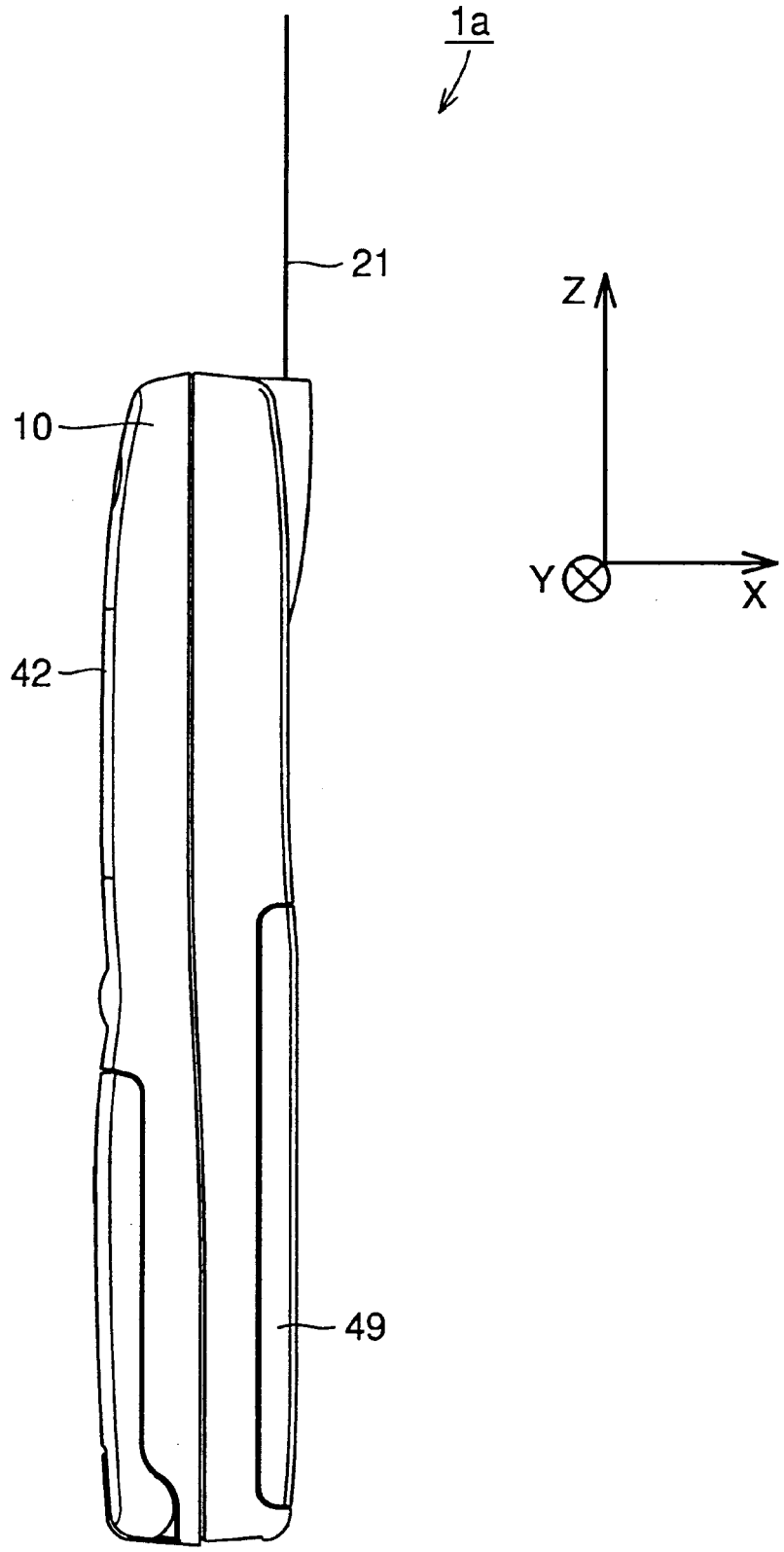
FIG. 9 is a side view of the portable telephone when viewed from the direction indicated by arrow IX of FIG. 8.

FIG. 9 is a side view of the portable telephone when viewed from the direction indicated by arrow IX in FIG. 8. Referring to FIG. 9, a battery 49 is attached to main case 10 of portable telephone 1*a*. Protection window 42 corresponding to a liquid crystal panel display is mounted at the front face of main unit case 10 whereas battery 49 is mounted at the back face of main unit case 10. The direction from battery 49 towards monopole antenna 21 is the +Z direction. The direction from protection window 42 to the back face of main unit case 10 is the +X direction. The direction at right angles to the paper plane of FIG. 9 towards the rear is the +Y direction.

Figure 10:
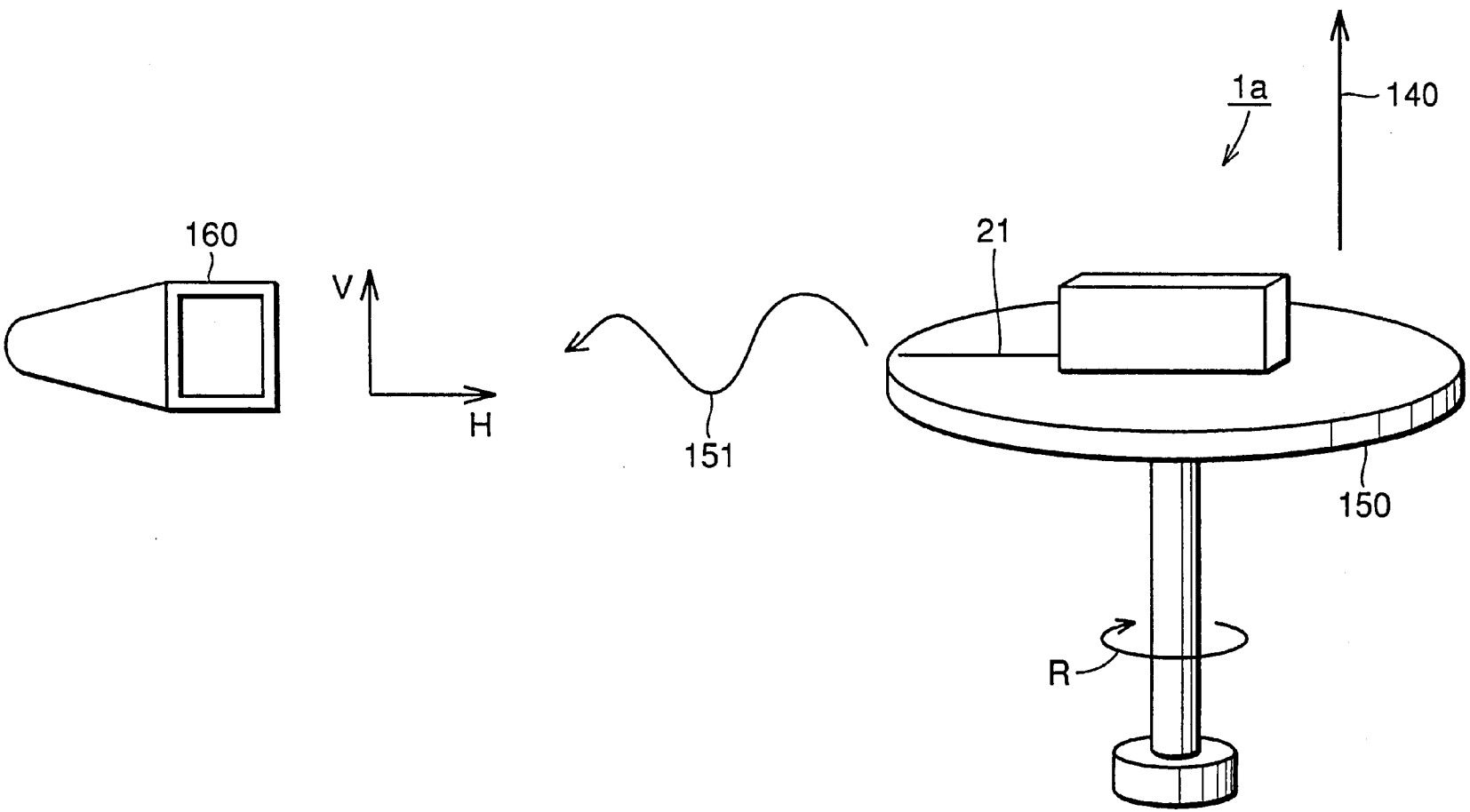
FIG. 10 shows the process of measuring the radiation pattern at the X-Z plane.
Figure 11:
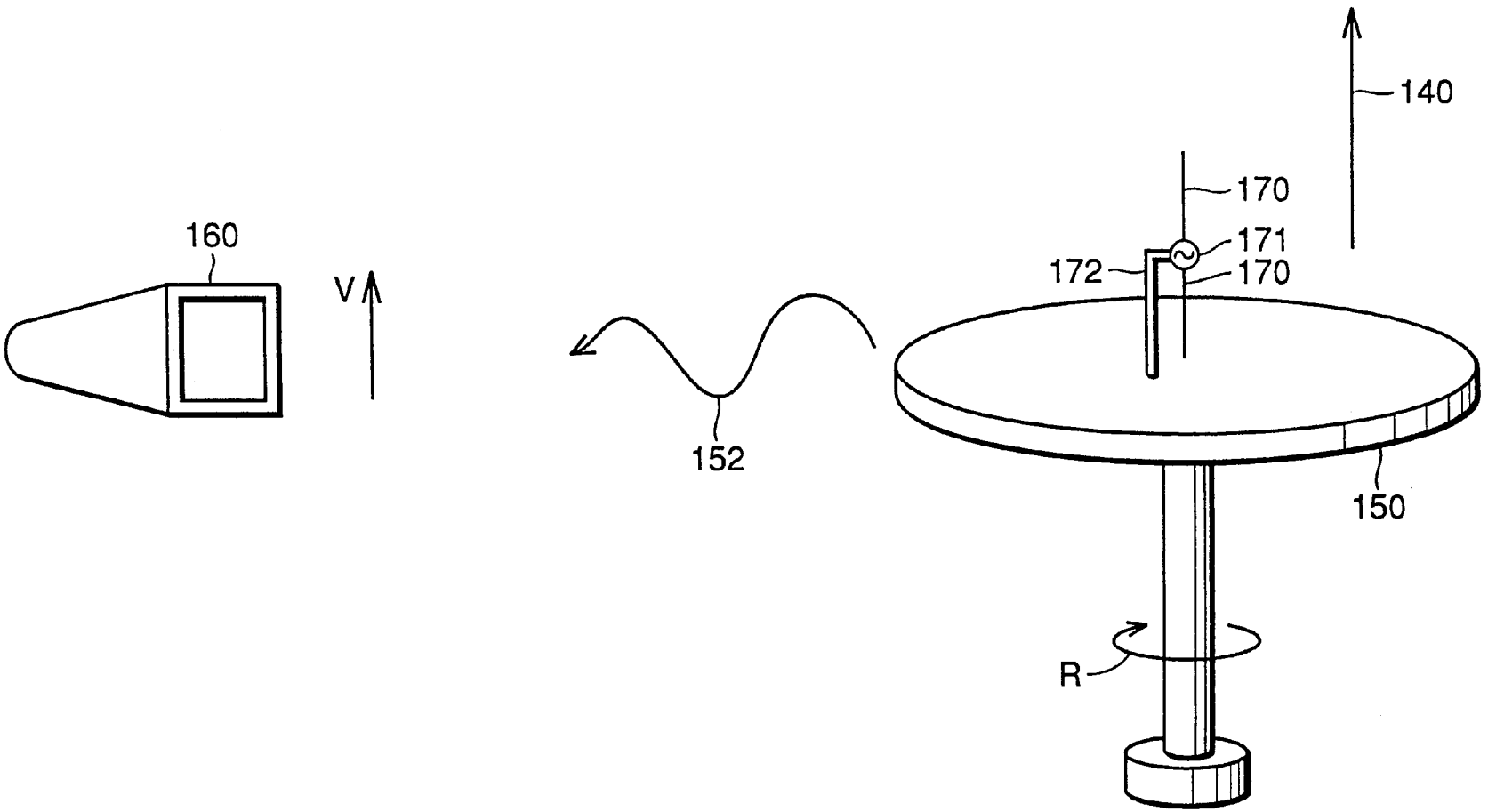
FIG. 11 shows the process of measuring the radiation pattern at the X-Z plane.
Figure 12:
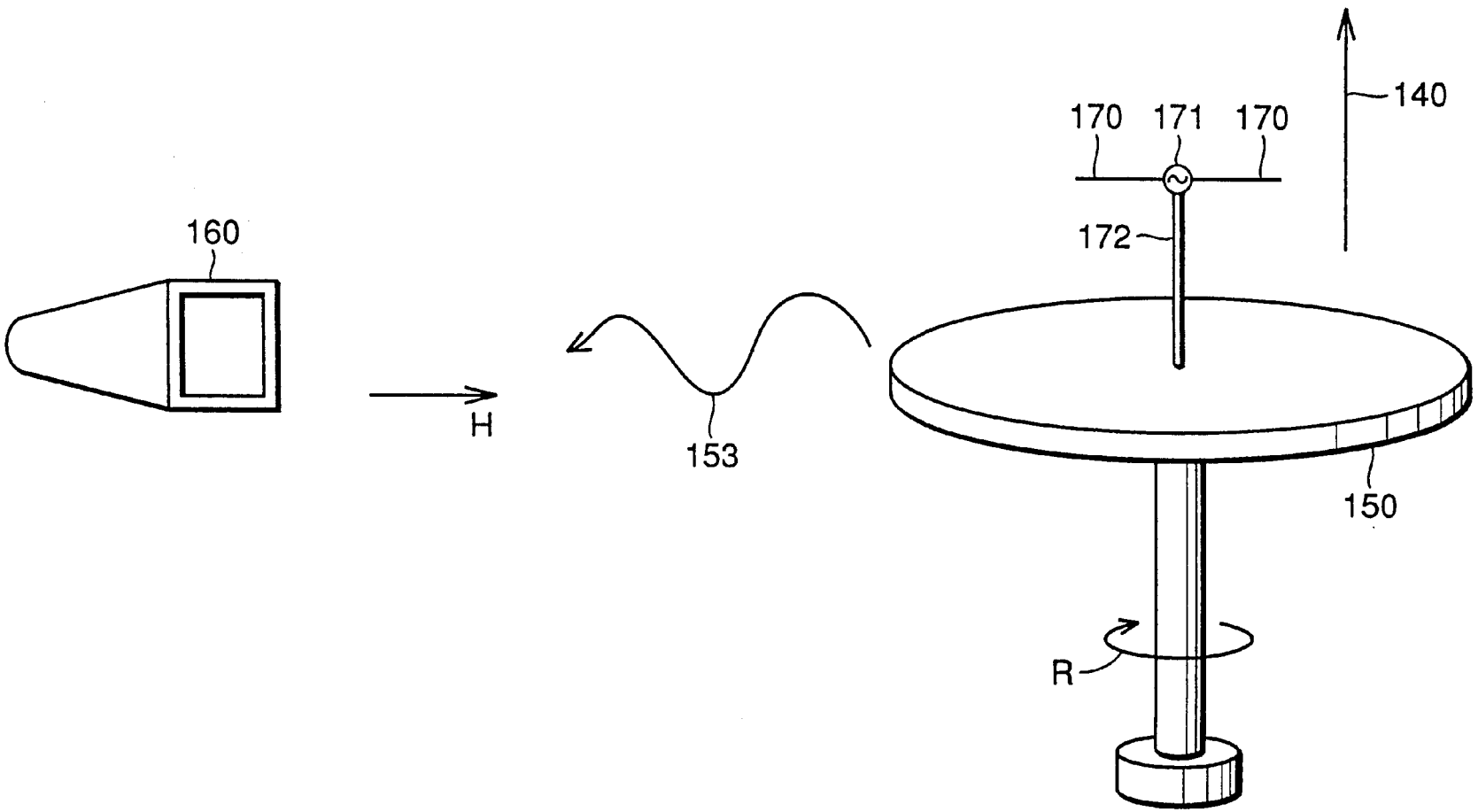
FIG. 12 shows the process of measuring the radiation pattern at the X-Z plane.

FIGS. 10–12 show the process of measuring the radiation pattern at the X-Z plane. Referring to FIG. 10, portable telephone 1*a* of FIGS. 8 and 9 was placed on a table 150. Here, portable telephone 1*a* was placed so that the extending direction of monopole antenna 21 (the +Z direction) and the X direction are substantially orthogonal to the perpendicular direction indicated by arrow 140. Accordingly, the +Y direction is substantially parallel to the direction indicated by arrow 140. Table 150 is rotatable in the direction indicated by arrow R.

With portable telephone 1*a* placed on table 150 as described above, a wave of 1.95 GHz in frequency was radiated via monopole antenna 21 in response to a predetermined output from the radio transmitter-receiver. Here, table 150 was rotated in the direction indicated by arrow R. As a result, a wave as shown by arrow 151 was emitted from monopole antenna 21. The electric field intensity of this wave was measured using a measurement-oriented antenna 160. The electric field intensity of the vertically polarized wave in the direction indicated by arrow V and the horizontally polarized wave in the direction indicated by arrow H was obtained.

Referring to FIG. 11, a dipole antenna 170 was placed on table 150. Dipole antenna 170 has a feeding point 171 provided at the center portion thereof to which a coaxial cable 172 is connected. Coaxial cable 172 is connected to a predetermined radio transmitter-receiver. Dipole antenna 170 extends in a direction substantially parallel to the perpendicular direction indicated by arrow 140. An output identical to that applied by the radio transmitter-receiver to monopole antenna 21 of FIG. 10 was supplied to dipole antenna 170 with table 150 rotated in the direction indicated by arrow R. A wave of 1.95 GHz in frequency indicated by arrow 152 was radiated from dipole antenna 170. Thus, a wave indicated by arrow 152 was radiated from dipole antenna 170. This wave is a vertically polarized wave in the direction indicated by arrow V. The electric field intensity of this wave was measured by measurement-oriented antenna 160.

Referring to FIG. 12, dipole antenna 170 was placed on table 150. Dipole antenna 170 was disposed so as to extend substantially orthogonal to the perpendicular direction indicated by arrow 140. Feeding point 171 is provided at the center of dipole antenna 170. Feeding point 171 is connected to a coaxial cable 172. An output identical to that applied to monopole antenna 21 of FIG. 10 by a radio unit was applied to dipole antenna 170 with table 150 rotated in the direction indicated by arrow R, whereby a wave of 1.95 GHz in frequency indicated by arrow 153 was radiated from dipole antenna 170. This wave is a horizontally polarized wave in the direction indicated by arrow H. The electric field intensity of this wave was obtained by measurement-oriented antenna 160.

The radiation pattern of the antenna element of the present invention was obtained based on the data obtained by the processes shown in FIGS. 10–12. The result is shown in FIG. 13.

Figure 13:
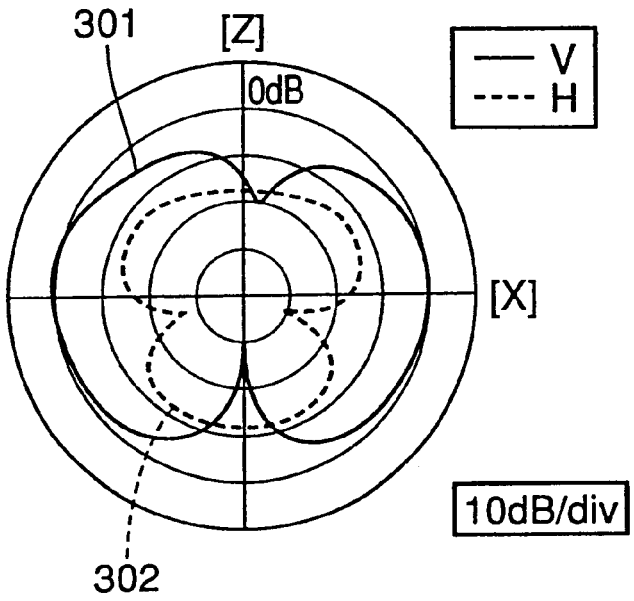
FIG. 13 is a graph showing the radiation pattern at the X-Z plane for a product of the present invention.

In FIG. 13, the solid line 301 indicates the gain of the vertical polarization component of the wave radiated from monopole antenna 21 of FIG. 10 with respect to the electric field intensity of the vertically polarized wave emitted from dipole antenna 170 in the process shown in FIG. 11. The gain was calculated according to the following equation.

(Gain)=20×$\log_{10}$ (electric field intensity of vertically polarized wave from monopole antenna 21/electric field intensity of vertically polarized wave from dipole antenna 170)

The dotted line 302 indicates the gain of the horizontal polarization of the wave emitted from monopole antenna 21 of FIG. 10 with respect to the electric field intensity of a horizontally polarized wave emitted from dipole antenna 170 in the process shown in FIG. 12. The gain was calculated according to the following equation.

(Gain)=20×$\log_{10}$ (electric field intensity of horizontally polarized wave from monopole antenna 210/electric field intensity of horizontally polarized wave from dipole antenna 170)

It is appreciated from FIG. 13 that the gain of vertical polarization is greater than the gain of horizontal polarization in portable telephone 1*a* of the present invention. In FIG. 13, one scale mark indicates 10 dB. The point on the X axis which is the horizontal axis in FIG. 13 corresponds to the point of the gain under the state where the X axis shown in FIGS. 8 and 9 is towards the direction of measurement-oriented antenna 160. The point on the Z axis which is the vertical axis is the point indicating the gain under the state where the Z axis shown in FIGS. 8 and 9 is towards the direction of measurement-oriented antenna 160.

The gains of the vertically and horizontally polarized waves (XPR (cross polarization ratio)=6 dB) were averaged to obtain the average gain. The average gain was −3.00 dBd. The peak value of gain was 0.61 dBd.

Figure 15:
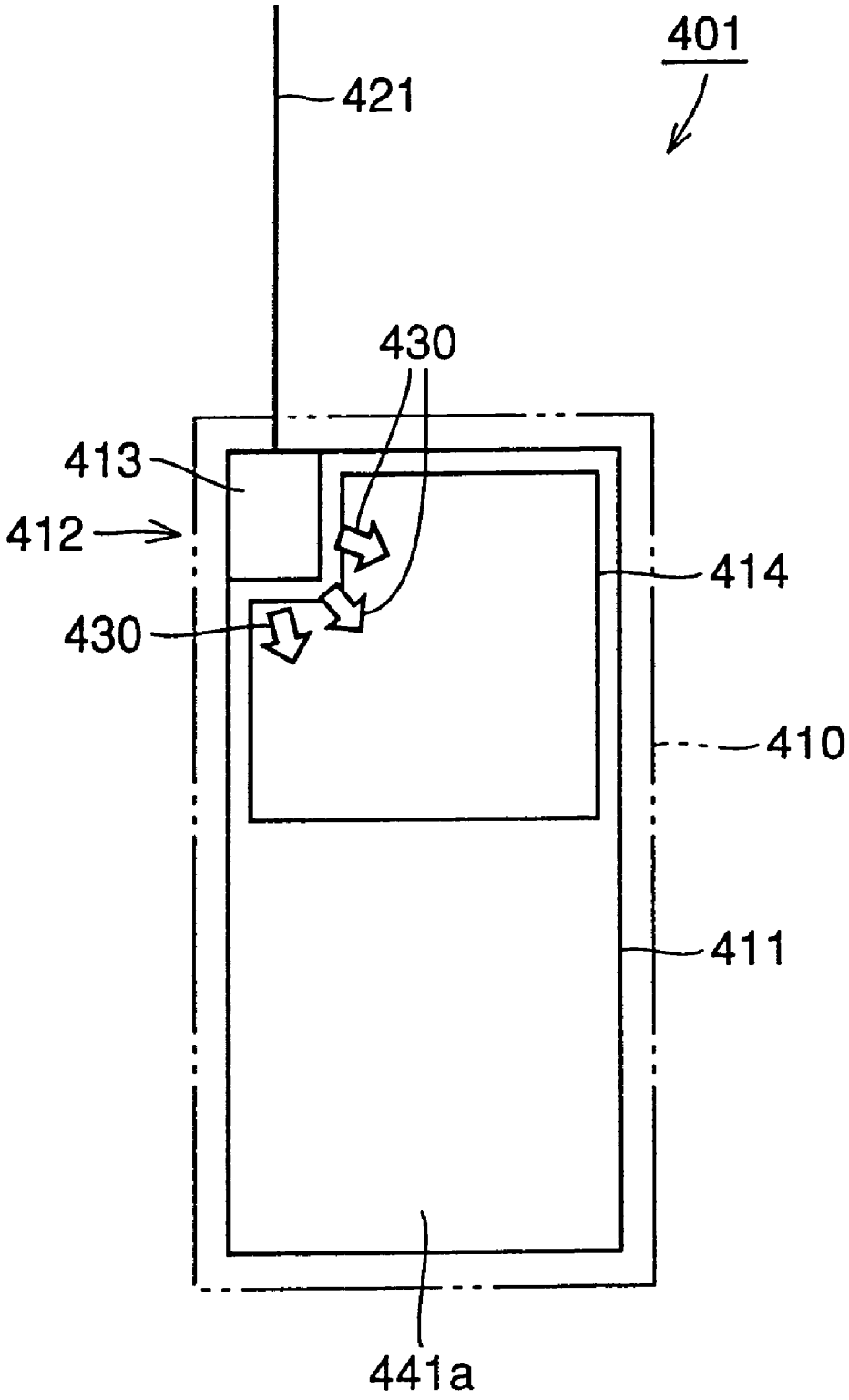
FIG. 15 PRIOR ART
FIG. 15 shows a structure of a conventional portable telephone.

Next, conventional portable telephone 401 of FIG. 15 was placed on table 150 so that the Z axis and the X axis are in the horizontal direction and the Y axis is in the perpendicular direction according to a process similar to that of FIG. 10. The size of metal substrate 411 shown in FIG. 15 was set similar to that of metal substrate 411. Under this state, a wave of 1.95 GHz in frequency was radiated via monopole antenna 421 with table 150 rotated in the direction indicated by arrow R. Here, an output similar to that applied to monopole antenna 421 by the radio transmitter-receiver was applied to monopole antenna 421. The vertical polarization component and horizontal polarization component of the radiated wave were measured using measurement-oriented antenna 160.

Figure 14:
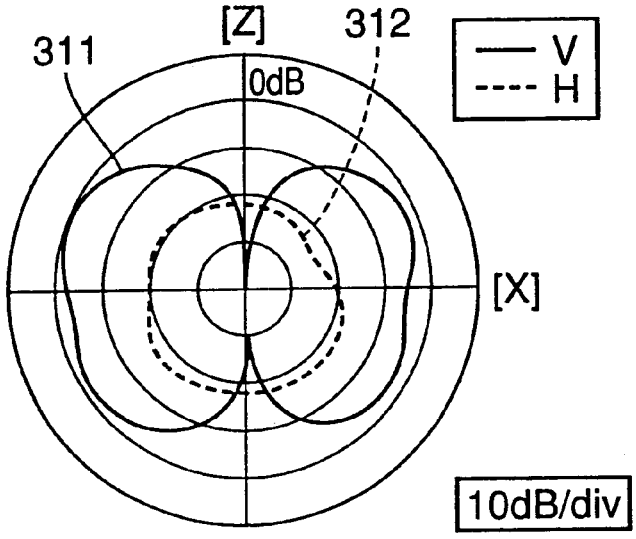
FIG. 14 PRIOR ART
FIG. 14 is a graph showing the radiation pattern at the X-Z plane for a conventional portable telephone.

The radiation pattern for such a conventional antenna is shown in FIG. 14. In FIG. 14, the solid line 311 indicates the gain of the electric field intensity of the vertical polarization component of the wave radiated from monopole antenna 421 according to the step shown in FIG. 10 with respect to the electric field intensity of the vertically polarized wave measured by the process of FIG. 11. This gain was calculated according to the following equation.

(Gain)=20×$\log_{10}$ (electric field intensity of vertically polarized wave from monopole antenna 421/electric field intensity of vertically polarized wave from dipole antenna 170)

The dotted line 312 indicates the gain of the electric field intensity of the horizontal polarization component of the wave radiated from monopole antenna 421 according to the process shown in FIG. 10 with respect to the electric field intensity of the horizontally polarized wave measured by the process shown in FIG. 12. This gain was calculated according to the following equation.

(Gain)=20×$\log_{10}$ (electric field intensity of horizontally polarized wave from monopole antenna 421/electric field intensity of horizontally polarized wave from dipole antenna 170)

It is appreciated from FIG. 14 that the gain of the horizontally polarized wave and the gain of the vertically polarized wave are both reduced. The average gain obtained from FIG. 14 was −4.74 dBd. The peak value of the gain was −1.13 dBd.

From the above results, it was confirmed that a portable telephone having a higher gain than that of the conventional product can be obtained by the present invention.

Industrial Applicability

The portable radio terminal of the present invention is applicable, not only to a portable telephone, but also to the field of portable information terminals such as a personal computer with communication capability.

What is claimed is:

1. A portable radio terminal comprising:

a substrate including a portion with a conductive surface;

a conductive shield member covering a radio transmitter-receiver provided on said substrate, electromagnetically shielding said radio transmitter-receiver;

an antenna element extending in a predetermined direction, having an electrical length of (λ/2)×N (N is an integer); and a feed unit provided at said substrate so as to be separated from and above an uppermost edge of said shield member in an extending direction of said antenna element, including a matching circuit connected to said antenna element.

2. The portable radio terminal according to claim 1, wherein a portion of a surface of said substrate at an end region is dielectric, and said feed unit is provided at the dielectric portion.

3. The portable radio terminal according to claim 1, wherein an end region of said substrate has a protruding portion, and said feed unit is provided at the protruding portion.

4. The portable radio terminal according to claim 1, wherein said shield member, said feed unit and said antenna element are provided in order in an extending direction of said antenna element to be apart from said substrate.

5. A portable radio terminal comprising:

a substrate having a conductive surface;

a conductive shield member covering a radio transmitter-receiver unit provided on said substrate, electromagnetically shielding said radio transmitter-receiver;

a dielectric provided on said substrate;

a feed unit provided on said dielectric so as to be apart from the surface of said substrate in a thickness direction of said substrate, and including a matching circuit; and an antenna element connected to said feed unit, and having an electrical length of $(\lambda/2)\times N$ (N is an integer), wherein an outer circumference of the dielectric completely surrounds an outer circumference of the matching circuit.

* * * * *